US006499307B1

(12) United States Patent
Peterson et al.

(10) Patent No.: US 6,499,307 B1
(45) Date of Patent: Dec. 31, 2002

(54) REFRIGERATION SYSTEM INCORPORATING SIMPLIFIED VALVE ARRANGEMENT

(75) Inventors: Clinton A. Peterson; Christopher J. Essenburg, both of Holland, MI (US)

(73) Assignee: Venturedyne, Ltd., Milwaukee, WI (US)

( * ) Notice: Subject to any disclaimer, the term of this patent is extended or adjusted under 35 U.S.C. 154(b) by 3 days.

(21) Appl. No.: 09/624,679

(22) Filed: Jul. 24, 2000

(51) Int. Cl.[7] ..... F25B 41/00; F25B 41/04
(52) U.S. Cl. ..... 62/196.1; 62/217
(58) Field of Search ..... 62/217, 176.6, 62/196.1

(56) References Cited

U.S. PATENT DOCUMENTS 3,858,407 A * 1/1975 Schumacher ..... 62/217
5,907,957 * 6/1999 Lee et al. ..... 62/217

FOREIGN PATENT DOCUMENTS

JP 406241580 * 8/1994 ..... 62/217

* cited by examiner

*Primary Examiner*—William Wayner
(74) *Attorney, Agent, or Firm*—Jansson, Shupe & Munger, Ltd.

(57) ABSTRACT

A refrigeration system is provided having refrigerant flowing therethrough. The refrigeration system provides temperature and humidity cooling within a chamber. The refrigeration system includes a compressor having an input and an output and an evaporator coil in communication with the chamber. A single expansion valve is provided in the input line to the evaporator coil for controlling the flow rate of the refrigerant delivered thereto and for limiting the pressure of refrigerant delivered to the input of the compressor.

20 Claims, 2 Drawing Sheets

REFRIGERATION SYSTEM INCORPORATING SIMPLIFIED VALVE ARRANGEMENT

FIELD OF INVENTION

This invention relates to refrigeration systems, and in particular, to a refrigeration system wherein the arrangement of the valves used for temperature and humidity cooling are simplified.

BACKGROUND AND SUMMARY OF THE INVENTION

Refrigeration systems are used to control the temperature and humidity in user selected environments such as test chambers. As is conventional, the refrigeration system includes evaporator coils positioned within (or adjacent) a chamber wherein the environment is to be controlled. Refrigerant is supplied to the evaporator coils by a conventional compressor/condenser system. The compressor receives refrigerant in a gaseous form from the evaporator coils and compresses the refrigerant. The heat of compression is removed by the condenser and the refrigerant is provided in liquid form to two distinct expansion valves, namely, a temperature-cooling expansion valve and a humidity-cooling expansion valve. The flow of refrigerant to the expansion valves is controlled by corresponding liquid solenoid valves. During temperature cooling, a user selects a desired temperature within the chamber and the flow of refrigerant is modulated by the liquid solenoid valve and by the temperature-cooling expansion valve in order to maintain the chamber at a user desired level. During humidity-cooling, a user selects a set point and the flow of refrigerant is modulated by the other liquid solenoid valve and by the humidity-cooling expansion valve in order to optimize the dry bulb temperature and predetermined humidity within the chamber. While functional for its intended purpose, this prior art arrangement is complex and requires additional amounts of labor to pipe and wire the necessary components.

Therefore, it is a primary object and feature of the present invention to provide a refrigeration system wherein the arrangement of the valves used for temperature and humidity cooling is simplified.

It is a further object and feature of the present invention to provide a refrigeration system with fewer components and greater reliability than prior art systems.

It is still a further object and feature of the present invention to provide a refrigeration system which is simple and inexpensive to construct.

It is a still further object and feature of the present invention to provide a refrigeration system which utilizes a single expansion valve for use in both temperature and humidity cooling.

In accordance with the present invention, a refrigeration system is provided having refrigerant flowing therethrough. The refrigeration system provides temperature and humidity cooling within a chamber. The refrigeration system includes a compressor having an input and an output. An evaporator coil is in communication with the chamber. The evaporator coil has an input operatively connected to the output of the compressor by an input line and an output operatively connected to the input of the compressor by an output line so as to allow the refrigerant to circulate between the compressor and the evaporator coil. An expansion valve is provided in the input line for controlling the flow rate of refrigerant delivered to the evaporator coil and for limiting the pressure of refrigerant delivered to the input of the compressor.

A liquid solenoid valve may be provided in the input line upstream of the expansion valve. The input solenoid valve controls the flow of refrigerant to the expansion valve. A pressure regulating valve is positioned in the output line. The pressure regulating valve maintains a minimum temperature of refrigerant within the evaporator coils so as to prevent moisture from freezing on the evaporator coil during humidity cooling. A suction solenoid valve is connected in parallel across the pressure regulating valve. The suction solenoid valve is movable between a first closed position wherein a refrigerant flows through the pressure regulating valve and a second opened position wherein the flow refrigerant bypasses the pressure regulating valve.

A sensing structure is operatively connected to the expansion valve and positioned adjacent the output line downstream of the pressure regulating valve. The sensing structure provides a signal to the expansion valve. The signal is provided by the sensing structure to the expansion valve and corresponds to the temperature of the refrigerant flowing through the output line and/or the pressure of the refrigerant flowing through the output line. The sensing structure may include a sensing bulb and/or an equalizer line.

In accordance with a still further aspect of the present invention, a refrigeration system is provided having refrigerant flowing therethrough. The refrigeration system provides temperature and humidity cooling within a chamber. The refrigeration system includes a compressor having an input and an output. An evaporator coil is in communication with the chamber. The evaporator coil has an input operatively connected to the compressor by an input line and output operatively connected to the input of the compressor by an output line so as to allow the refrigerant to circulate between the compressor and the evaporator coil. A pressure regulating signal is provided in the output line for maintaining a minimum temperature of refrigerant within the evaporator coils so as to prevent moisture from freezing in the evaporator during humidity cooling. A suction solenoid valve is connected in parallel with the pressure regulating valve. The suction solenoid valve is movable between a first closed position to prevent the flow of refrigerant therethrough and a second opened position allowing the flow of refrigerant therethrough.

A sensing structure may be operatively connected to the expansion valve in a position adjacent the output line downstream of the pressure regulating valve. The sensing structure provides at least one signal to the expansion valve. The expansion valve varies the flow rate of the refrigerant delivered to the input of the evaporator coil in response to the at least one signal received from the sensing structure. The sensing structure may include a sensing bulb for providing a temperature signal to the expansion valve which corresponds to the temperature of the refrigerant flowing through the output line. The sensing structure may also include an equalizer line for providing a pressure signal to the expansion valve which corresponds to the pressure of the refrigerant flowing through the output line. It is contemplated that the pressure of the refrigerant delivered to the input of the evaporator coil be sufficient to prevent moisture from freezing on the evaporator coil during humidity cooling.

In accordance with a still further aspect of the present invention, a refrigeration system is provided having refrigerant flowing therethrough. The refrigerant system provides temperature and humidity cooling within a chamber and includes a compressor having an input and an output. An evaporator coil is in communication with the chamber. The evaporator coil has an input operatively connected to the compressor by an input line and output operatively connected to the input of the compressor by an output line so as to allow the refrigerant to circulate between the compressor and the evaporator coil. An expansion valve is provided in the input line for varying the flow rate of refrigerant delivered to the input of the evaporator coil. A pressure regulating valve is positioned in the output line. The pressure regulating valve maintains a minimum temperature of refrigerant within the evaporator coil. A suction solenoid valve connected in parallel to the pressure regulating valve is movable between a first closed position for preventing the flow of refrigerant therethrough and a second opened position for allowing the refrigerant therethrough. A second bulb is operatively connected to the expansion valve. The sensing valve provides a temperature signal to the expansion valve which corresponds to the temperature of the refrigerant flowing through the output line. An equalizer line is operatively connected to the expansion valve. The equalizer line provides a pressure signal to the expansion valve which corresponds to the pressure of the refrigerant flowing through the output line. It is contemplated that the expansion valve varies the flow rate of refrigerant delivered to the input of the evaporator coil in response to the temperature signal.

A condenser may be positioned in the input line to remove heat from the refrigerant exiting from the compressor. A liquid solenoid valve is also provided in the input line and upstream of the expansion line. The liquid solenoid valve controls the flow of refrigerant to the expansion valve. The pressure of the refrigerant delivered to the input of the evaporator coil is sufficient to prevent moisture from freezing on the evaporator coil during humidity cooling.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

DETAILED DESCRIPTION OF THE DRAWINGS

Figure 1:
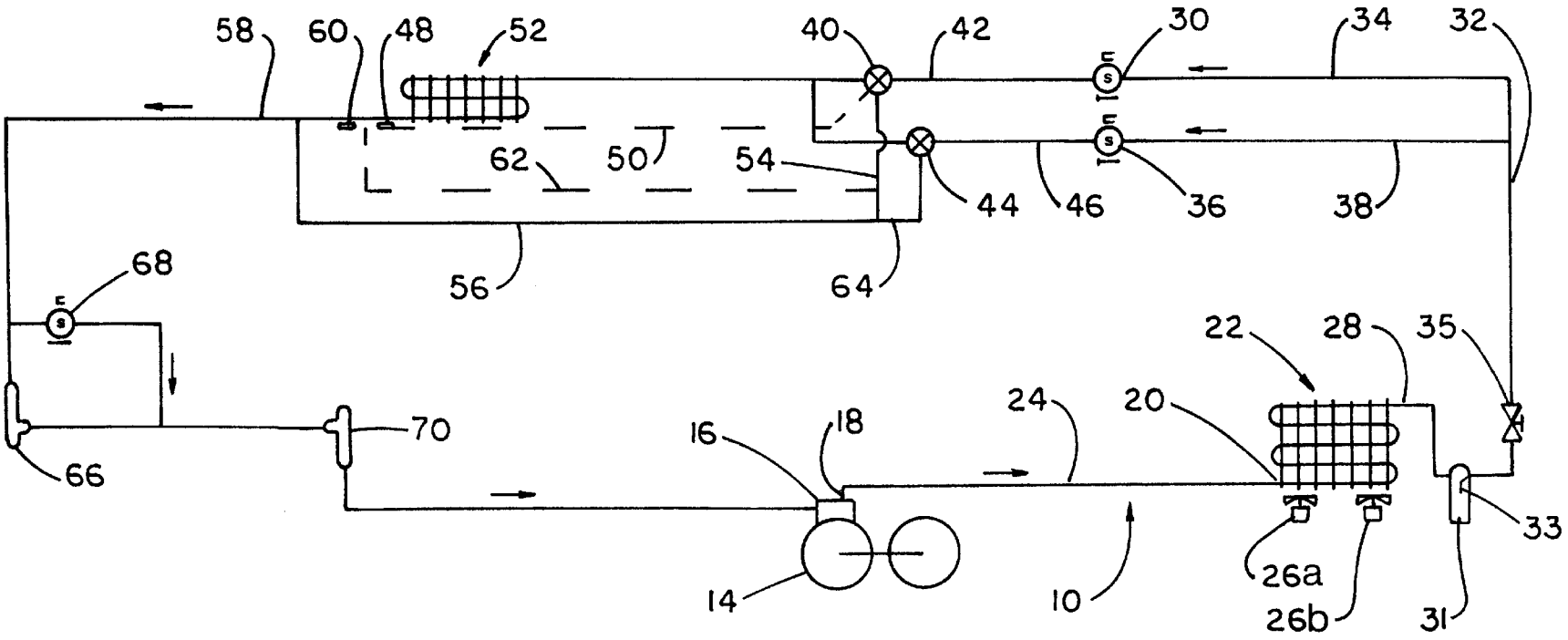
FIG. 1 PRIOR ART
FIG. 1 is a schematic view of a prior art refrigeration system.

Referring to FIG. 1, a prior art refrigeration system is generally designated by the reference numeral 10. As is conventional, refrigeration system 10 has refrigerant flowing therethrough in a manner hereinafter described. Refrigeration system 10 includes a compressor 14 having an input 16 and an output 18. Output 18 of compressor 14 is interconnected to input 20 of condenser 22 by line 24. Fans 26*a* and 26*b* provide for the flow of air over the coils of condenser 22, for reasons hereinafter described.

Output 28 of condenser 22 is interconnected to liquid solenoid valve 30 through lines 32 and 34. Temperature-cooling expansion valve 40 is interconnected to liquid solenoid valve 30 by line 42 such that refrigerant flowing to temperature-cooling expansion valve 40 through line 42 is controlled by liquid solenoid valve 30. As is conventional, the opening and closing of liquid solenoid valve 30 is controlled by a control program.

Similarly, output 28 of condenser 22 is also connected to liquid solenoid valve 36 by lines 32 and 38. Liquid solenoid valve 36 is connected to humidity-cooling expansion valve 44 by line 46. Refrigerant flowing to humidity-cooling expansion valve 44 through line 46 is controlled by liquid solenoid valve 36. As is conventional, the opening and closing of liquid solenoid valve 36 is controlled by a controlled program.

Sensing bulb 48 is operatively connected to temperature-cooling expansion valve 40 by line 50 at a position downstream of evaporator coils 52 in order to monitor the temperature of the refrigerant exiting evaporator coils 52. Equalizer line 56 communicates with output line 58 of evaporator coil 52 in order to allow temperature-cooling expansion valve 40 to monitor the pressure of the refrigerant exiting the evaporator 52 through equalizer lines 54 and 56.

Sensing bulb 60 is operatively connected to humidity-cooling expansion valve 44 by line 62 and is positioned downstream of evaporator coils 52 in order to monitor the temperature of refrigerant exiting evaporator coils 52. Equalizer lines 56 and 64 allow humidity-cooling expansion valve 44 to monitor the pressure of the refrigerant in output line 58 exiting evaporator coils 52.

Output line 58 is interconnected to input 16 of compressor 14 and includes an evaporator pressure regulating valve 66 and a suction solenoid valve 68 connected in parallel. A crank case pressure regulating valve 70 is positioned in the output line 58 downstream of the evaporator pressure regulating valve 66 and suction solenoid valve 68 parallel combination.

In operation, a user selects the type of cooling desired in a chamber communicating with evaporator coils 52. During temperature cooling, the temperature in the chamber is maintained by refrigeration system 10 at a predetermined, user-selected level. During humidity cooling, the dry bulb temperature and the humidity within the chamber are maintained by refrigeration system 10 at predetermined, user-selected levels. In a temperature cooling mode, liquid solenoid valve 30 is opened by the control program so as to allow a predetermined flow of refrigerant therethrough to temperature-cooling expansion valve 40, while liquid solenoid valve 36 is closed so as to prevent the flow of refrigerant therethrough to humidity-cooling expansion valve 44. Alternatively, in humidity cooling mode, liquid solenoid valve 36 is opened so as to allow for a predetermined flow of refrigerant to humidity-cooling expansion valve 44 and liquid solenoid valve 30 is closed so as to prevent the flow of refrigerant to temperature-cooling expansion valve 40.

Compressor 14 compresses the refrigerant therein such that high-pressure, high-temperature refrigerant exits the compressor 14 through line 24. The high-pressure, high-temperature refrigerant passes through condenser 22 wherein a heat exchange is effectuated between the high-pressure, high-temperature refrigerant exiting compressor 14 and the air flowing over the coils of condenser 22 so as to remove heat from the refrigerant and to change the refrigerant to a liquid state. The cooled, high-pressure refrigerant is deposited in vertical receiver tank 31 and drawn therefrom through dip-tube 33.

The refrigerant flows through shut-off valve 35, line 32, and lines 34 and 38 to corresponding liquid solenoid valves 30 and 36, respectively. As heretofore described, during temperature cooling, liquid solenoid valve 36 is closed and the refrigerant flows through liquid solenoid valve 30 to temperature-cooling expansion valve 40. Temperature-cooling expansion valve 40 modulates in response to the temperature sensed by sensing bulb 48 and the pressure of refrigerant exiting evaporator coils 52 through line 58 in order to adjust the temperature of the refrigerant passing through evaporator coils 52, and hence, the temperature of the chamber in communication with the evaporator coils 52.

During humidity cooling, liquid solenoid valve 30 is closed and liquid solenoid valve 36 is opened such that the refrigerant flows to humidity-cooling expansion valve 44 through line 46. Humidity-cooling expansion valve 44 modulates in response to the temperature sensed by sensing bulb 60 and the pressure of the refrigerant exiting evaporator coils 52 thereby adjusting the dry bulb temperature and the pressure of the refrigerant passing through evaporator coils 52, and hence, the dry bulb temperature and the humidity within the chamber which communicates with evaporator coils 52. As is known, the cooled, high-pressure refrigerant expands in evaporator coils 52 and returns to a gaseous state. Evaporator pressure regulating valve 66 maintains a minimum pressure and temperature for the refrigerant in the evaporator coils 52 by regulating the pressure in output line 58, and hence, in evaporator coils 52 so that the moisture does not freeze on the evaporator coils 52 during humidity cooling.

Alternatively, during temperature cooling, suction solenoid valve 68 is opened so as to allow the refrigerant to bypass the evaporator regulating valve 66 since there is no need to maintain a minimum pressure in the evaporator coils 52. Crank case pressure regulating valve 70 is provided to limit the pressure of refrigerant provided to the input 16 of compressor 14 through line 58 in order that the motor which drives compressor 14 does not become overloaded.

Figure 2:
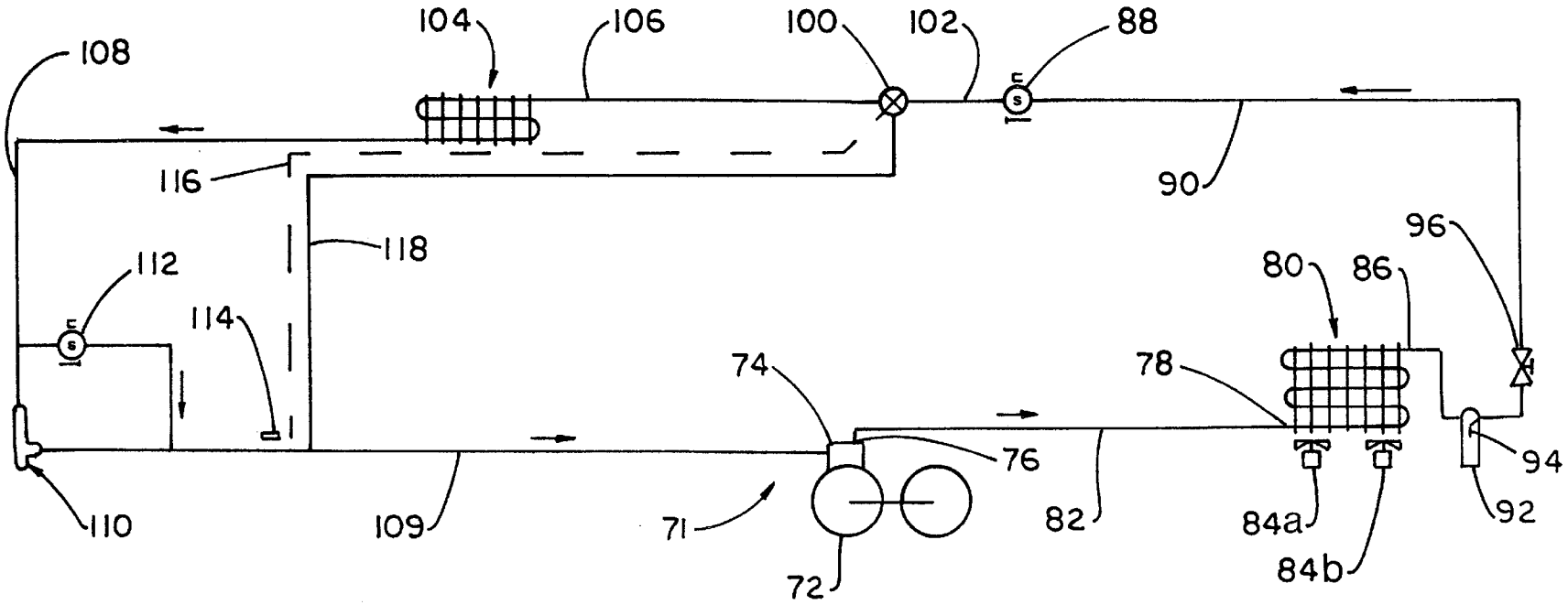
FIG. 2 is a schematic view of a refrigeration system in accordance with the present invention.

Referring to FIG. 2, a refrigeration system in accordance with the present invention is generally designated by the reference numeral 71. As is conventional, refrigeration system 71 has refrigerant flowing therethrough in a manner hereinafter described. The refrigeration system 71 includes a compressor 72 having an input 74 and an output 76. Output 76 of compressor 72 is interconnected to the input 78 of condenser 80 by line 82. Fans 84*a* and 84*b* provide for the flow of air over the coils of the condenser 80, for reasons hereinafter described.

Refrigerant 86 is interconnected to liquid solenoid valve 88 by line 90. Line 90 includes vertical receiver tank 92 for receiving cooled, high-pressure refrigerant 86 received from condenser 80. A dip-tube 94 extends into vertical receiver tank 92 below the level of liquid refrigerant liquid therein so as to draw liquid refrigerant from vertical receiver tank 92 and to provide the same in line 90. Line 90 further includes a shut-off valve 96 to control the flow of refrigerant therethrough.

Temperature/humidity cooling expansion valve 100 is interconnected to liquid solenoid valve 88 by line 102 such that refrigerant flowing through temperature/humidity expansion valve 88 through line 102 is controlled by liquid solenoid valve 88. As is conventional, opening and closing of liquid solenoid valve 88 is controlled by a control program.

Evaporator coils 104 are interconnected to temperature/humidity expansion valve 100 by line 106 and to input 74 of compressor 72 by output lines 108 and 109. Output lines 108 and 109 include an evaporator pressure regulating valve 110 and a suction solenoid valve 112 connected in parallel therebetween. A sensing bulb 114 is operatively connected to temperature/humidity expansion valve 100 by line 116. Sensing bulb 114 is positioned downstream of the evaporator pressure regulating valve 110 and suction solenoid valve 112 in parallel combination in order to monitor the temperature of the refrigerant exiting evaporator coils 104. Equalizer line 118 communicates with output line 109 downstream of the evaporator pressure regulating valve 110 and suction solenoid valve 112 parallel combination in order to allow temperature/humidity cooling expansion valve 100 to monitor the pressure of the refrigerant in output line 109.

In operation, the user selects the type of cooling, namely, temperature or humidity, desired in the chamber communicating with the evaporator coils 104 and the characteristics associated therewith, i.e. temperature and humidity. Compressor 72 compresses the refrigerant therein such that high-pressure, high-temperature refrigerant exits the compressor 72 through line 82. The high-pressure, high-temperature refrigerant passes through condenser 80 wherein a heat exchange is effectuated between the high-pressure, high-temperature refrigerant exiting compressor 72 and the air flowing over the coils of condenser 80 so as to remove heat from the refrigerant and to change the refrigerant to a liquid state. The cooled, high-pressure refrigerant is deposited in vertical receiver tank 92 and drawn therefrom by dip-tube 94.

The refrigerant flows through shut-off valve 96, line 90 and liquid solenoid valve 88 to temperature/humidity cooling expansion valve 100. The flow of refrigerant through liquid solenoid valve 88 is dictated by a user-selected setting. During temperature cooling, temperature/humidity cooling expansion valve 100 modulates in response to the temperature sensed by sensing bulb 114 and the pressure of refrigerant in equalizer line 118 such that the temperature of the refrigerant passing through the evaporator coils 104 is maintained at the user-selected level.

During humidity cooling, temperature/humidity cooling expansion valve 100 also modulates in response to the temperature sensed by sensing bulb 114 and the pressure of refrigerant in equalizer line 118 such that the dry bulb temperature and the pressure of the refrigerant passing through evaporator coils 104 is maintained at the user-selected levels. As is known, during humidity cooling, evaporator pressure regulating valve 110 limits the pressure of refrigerant in output line 108. In addition, the refrigerant passing through expansion valve 100 and evaporator pressure regulating valve 110 will expand in a throttling process to reduce the pressure of the refrigerant in output line 109 at equalizer line 118 and sensing bulb 114 such that the suction pressure at input 74 of compressor 72 is limited and the compressor motor will not be overloaded.

As described, refrigeration system 71 eliminates crank case pressure regulating valve 70 (FIG. 1), since sensing bulb 114 and equalizer line 118 in communication with expansion valve 100 limit the suction pressure in output line 109 such that the compressor motor will not be overloaded. Further, a single expansion valve 100 may be used to effectuate both temperature and humidity cooling. Consequently, the refrigeration system 71 of the present invention requires less labor to pipe and wire the components, and requires fewer components than prior art refrigeration systems.

Various modes of carrying out the invention are contemplated as being within the scope of the following claims particularly pointing out and distinctly claiming the subject matter which is regarded as the invention.

We claim:

1. A refrigeration system having refrigerant flowing therethrough, the refrigeration system providing temperature-cooling and humidity-cooling within a chamber and comprising:

a compressor having an inlet and an outlet;

an evaporator coil in communication with the chamber, the evaporator coil having an input operatively connected to the outlet by an input line and an output operatively connected to the inlet by an output line so as to allow the refrigerant to circulate between the compressor and the evaporator coil;

an expansion valve provided in the input line for controlling the flow rate of refrigerant delivered to the input;

an evaporator-pressure regulating valve in the output line for maintaining a minimum temperature of the refrigerant within the evaporator coils to prevent moisture from freezing on the evaporator coil during humidity-cooling;

a bypass connected with respect to the system for bypassing the evaporator-pressure regulating valve during temperature-cooling; and a sensing structure operatively connected to the expansion valve and positioned on the output line downstream of the evaporator-pressure regulating valve, the sensing structure providing a signal to the expansion valve.

2. The refrigeration system of claim 1 further comprising a liquid solenoid valve provided in the input line upstream of the expansion valve, the liquid solenoid valve having an open position and a closed position for controlling the flow of refrigerant to the expansion valve.

3. The refrigeration system of claim 1 wherein the bypass includes a suction solenoid valve having an entrance connected to the output line upstream of the evaporator-pressure regulating valve and an exit connected to the output line downstream of the evaporator-pressure regulating valve, the suction solenoid valve movable between a first closed position for use during humidity-cooling wherein the refrigerant flows through the evaporator-pressure regulating valve and a second open position for use during temperature-cooling wherein the refrigerant bypasses the evaporator-pressure regulating valve.

4. The refrigeration system of claim 1 wherein the sensing structure provides a signal to the expansion valve and the expansion valve adjusts the flow rate of refrigerant in response to the signal.

5. The refrigeration system of claim 4 wherein the signal provided by the sensing structure to the expansion valve corresponds to the temperature of the refrigerant flowing through the output line.

6. The refrigeration system of claim 5 wherein the sensing structure includes a sensing bulb.

7. The refrigeration system of claim 4 wherein the signal provided by the sensing structure to the expansion valve corresponds to the pressure of the refrigerant flowing through the output line.

8. The refrigeration system of claim 7 wherein the sensing structure includes a equalizer line.

9. The refrigeration system of claim 1 further comprising a condenser in the input line, the condenser removing heat from the refrigerant exiting the compressor.

10. The refrigeration system of claim 1 wherein the bypass has an entrance and an exit, the entrance being connected to the output line upstream of the evaporator-pressure regulating valve and the exit being connected to the output line downstream of the evaporator-pressure regulating valve.

11. A refrigeration system having refrigerant flowing therethrough, the refrigeration system providing temperature-cooling and humidity-cooling within a chamber and comprising:

a compressor having an inlet and an outlet;

an evaporator coil in communication with the chamber, the evaporator coil having an input operatively connected to the outlet by an input line and an output operatively connected to the inlet by an output line so as to allow the refrigerant to circulate between the compressor and the evaporator coil;

an expansion valve provided in the input line for controlling the flow rate of refrigerant delivered to the input;

an evaporator-pressure regulating valve in the output line for maintaining a minimum pressure of the refrigerant within the evaporator coils;

a suction solenoid valve connected in parallel with the evaporator-pressure regulating valve, the suction solenoid valve movable between a first closed position preventing the flow of refrigerant therethrough and a second open position allowing the flow of refrigerant therethrough; and a sensing structure operatively connected to the expansion valve and positioned on the output line downstream of the suction solenoid valve and evaporator-pressure regulating valve, the sensing structure providing at least one signal to the expansion valve.

12. The refrigeration system of claim 11 wherein the sensing structure includes a sensing bulb, the sensing bulb providing a temperature signal to the expansion valve which corresponds to the temperature of the refrigerant flowing through the output line near the sensing structure.

13. The refrigeration system of claim 11 wherein the sensing structure includes a equalizer line, the equalizer line providing a pressure signal to the expansion valve which corresponds to the pressure of the refrigerant flowing through the output line near the sensing structure.

14. The refrigeration system of claim 11 further comprising:

a sensing bulb positioned at the output line downstream of the evaporator-pressure regulating valve and the suction solenoid valve and operatively connected to the expansion valve, the sensing bulb providing a temperature signal to the expansion valve which corresponds to the temperature of the refrigerant flowing through the output line near the sensing bulb; and an equalizer line in communication with the output line downstream of the evaporator-pressure regulating valve and the suction solenoid valve and operatively connected to the expansion valve, the equalizer line providing a pressure signal to the expansion valve which corresponds to the pressure of the refrigerant flowing through the output line near the equalizer line;

wherein the expansion valve varies the flow rate of the refrigerant delivered to the input of the evaporator coil responsive to the temperature signal and the pressure signal.

15. The refrigeration system of claim 14 further comprising a condenser in the input line, the condenser removing heat from the refrigerant exiting the compressor.

16. The refrigeration system of claim 14 further comprising a liquid solenoid valve provided in the input line upstream of the expansion valve, the liquid solenoid valve controlling the flow of refrigerant to the expansion valve.

17. The refrigeration system of claim 14 wherein the pressure maintained by the evaporator-pressure regulating valve in the evaporator coil is sufficient to prevent moisture from freezing on the evaporator coil during humidity-cooling.

18. A refrigeration system having refrigerant flowing therethrough, the refrigeration system providing temperature-cooling and humidity-cooling within a chamber and comprising:

a compressor having an inlet and an outlet;

an evaporator coil in communication with the chamber, the evaporator coil having an input operatively connected to the outlet by an input line and an output operatively connected to the inlet by an output line so as to allow the refrigerant to circulate between the compressor and the evaporator coil;

an expansion valve provided in the input line for controlling the flow rate of refrigerant delivered to the input;

an evaporator-pressure regulating valve in the output line for maintaining a minimum temperature of the refrigerant within the evaporator coils to prevent moisture from freezing on the evaporator coil during humidity-cooling; and a sensing structure operatively connected to the expansion valve and positioned on the output line downstream of the evaporator-pressure regulating valve, the sensing structure providing a signal to the expansion valve, the signal corresponding to the temperature of the refrigerant flowing through the output line and the expansion valve adjusting the flow rate of refrigerant in response to the signal.

19. The refrigeration system of claim 18 wherein the sensing structure includes a sensing bulb.

20. The refrigeration system of claim 18 wherein the sensing structure includes a equalizer line, the equalizer line providing a pressure signal to the expansion valve which corresponds to the pressure of the refrigerant flowing through the output line near the sensing structure.

* * * * *